United States Patent [19]

Collins

[11] 3,972,455

[45] Aug. 3, 1976

[54] PANTS AND SKIRT HANGER

[76] Inventor: Wesley A. Collins, P.O. Box 333, Chula Vista, Calif. 92012

[22] Filed: Oct. 2, 1975

[21] Appl. No.: 619,131

[52] U.S. Cl. ..... 223/96; 211/119; 248/340

[51] Int. Cl.[2] ..... A47J 51/14

[58] Field of Search ..... 223/91, 95, 96, 93; 211/113, 89, 124, 119; 248/317, 340, 324

[56] References Cited

UNITED STATES PATENTS

| | | | |
|---|---|---|---|
| 789,180 | 5/1905 | Spruce | 223/96 |
| 2,119,934 | 6/1938 | Woods | 223/96 |
| 3,118,544 | 1/1964 | Franklin | 223/91 X |
| 3,866,809 | 2/1975 | Janes | 211/119 X |

FOREIGN PATENTS OR APPLICATIONS

| | | | |
|---|---|---|---|
| 812,821 | 9/1951 | Germany | 223/92 |

*Primary Examiner*—George H. Krizmanich
*Attorney, Agent, or Firm*—Isbell & Charmasson

[57] ABSTRACT

A garment hanging device designed to hold a pair of pants or a skirt, formed from two gripping sections clamped together by a locking lever and hinged around an axial support. The axial support can be provided in a variety of configurations allowing the garment to be either pulled out of its rack enclosure for examination, or removed from the hanger without disconnecting the device from its mounting place or supporting rod.

2 Claims, 7 Drawing Figures

PANTS AND SKIRT HANGER

BACKGROUND OF THE INVENTION

Conventional pants and skirt hangers feature a rigidly mounted suspending hook, acting also as clamping lever. The hanging garment cannot be inspected or removed without unhooking the hanger from its supporting rod. Furthermore, lateral space is required to allow access to the hanger. In mass display areas, such as in clothing stores, conventional hangers, manipulated by customers sometimes come off their supporting rod. There are two problems thus generated. First, merchandise is often damaged from falling to the floor, and secondly, busy clerks in replacing the hangers often return the merchandise to the wrong area, thus confusing the customer in his search for correct size and style.

Removable hangers are frequently stolen from hotel and motel rooms. Non-removable types currently available are expensive to fabricate and inconvenient to use.

It is one object of this invention to provide a garment hanger which can be permanently attached to its supporting structure and which allows easy access for inspection.

Another object of this invention is to provide a skirt and pants hanger with holding, gripping members hinged around an axial support which may be provided in various suspending configurations.

Another object of this invention is to provide a skirt and pants hanger which has an independent actuating level so that the holding pressure can be released without any lateral movement of the hanger itself.

A further object of this invention is to provide a hanger for arranging garments in close proximity to each other, permitting each garment to be moved into viewing position without removing the garment from its hanger.

An additional object is to provide an inexpensive, nonremovable hanger which is easy to install and operate.

These and other objects of this invention will become apparent from the following description. The invention combines a pair of gripping elements hinged around an axial support or shaft and clamped together by an independent latching lever.

The shaft can be fastened to the supporting structure in multiple configurations to allow for various movements of the hanger without disconnecting it from the supporting structures.

IN THE DRAWINGS

DESCRIPTION OF THE PREFERRED EMBODIMENTS

Figures 1, 2, 3, 4, 5, 6:
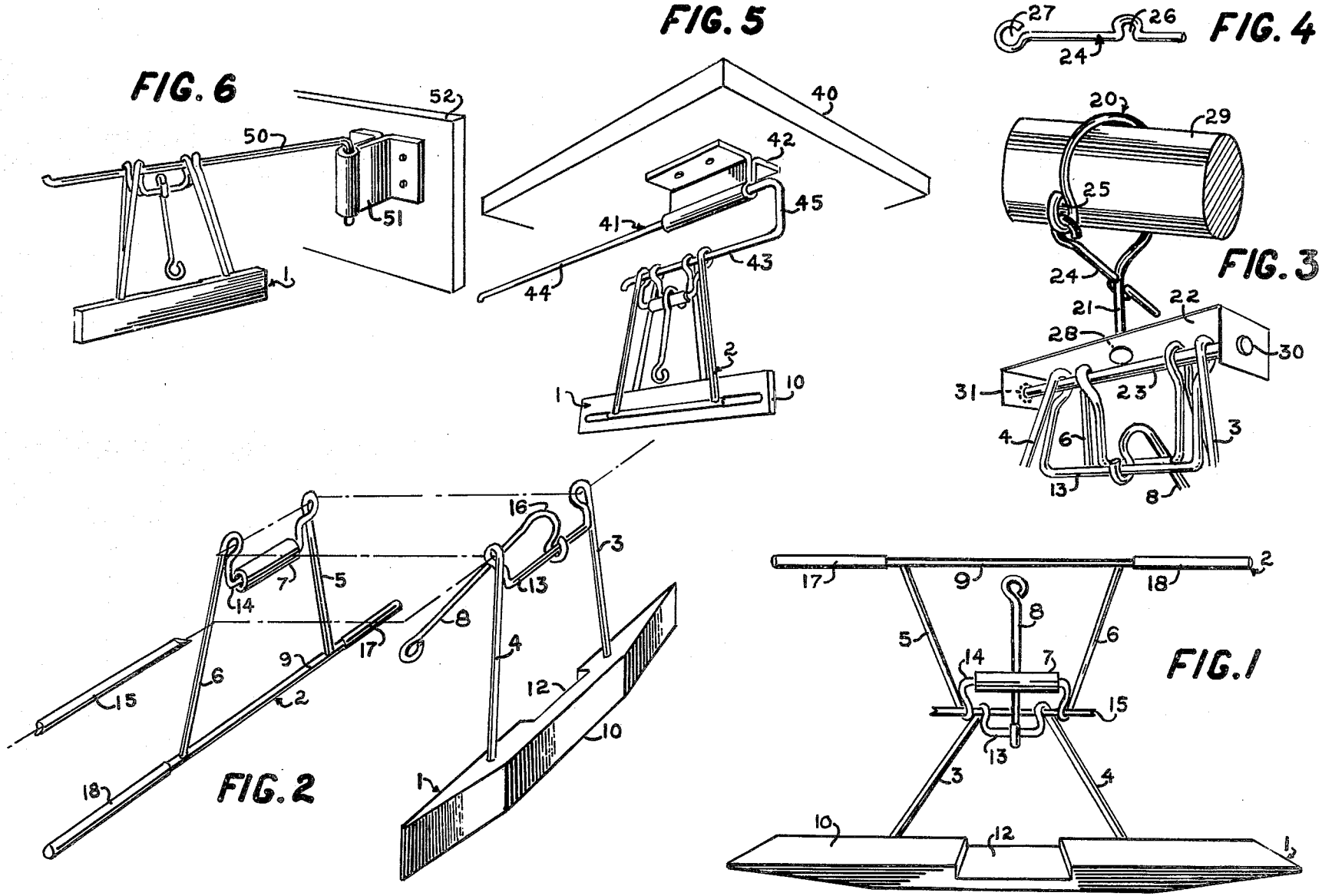
FIG. 1 is a bottom view of the basic hanger without suspending assembly.
FIG. 2 is an exploded perspective view of the basic hanger shown in FIG. 1.
FIG. 3 is a perspective enlarged view of a hook and shaft assembly.
FIG. 4 is a frontal view of a locking pin.
FIG. 5 is a perspective view of a hanger mounted in a sliding out configuration.
FIG. 6 is a perspective view of a shaft mounted in a pivotal configuration.
Figure 7:
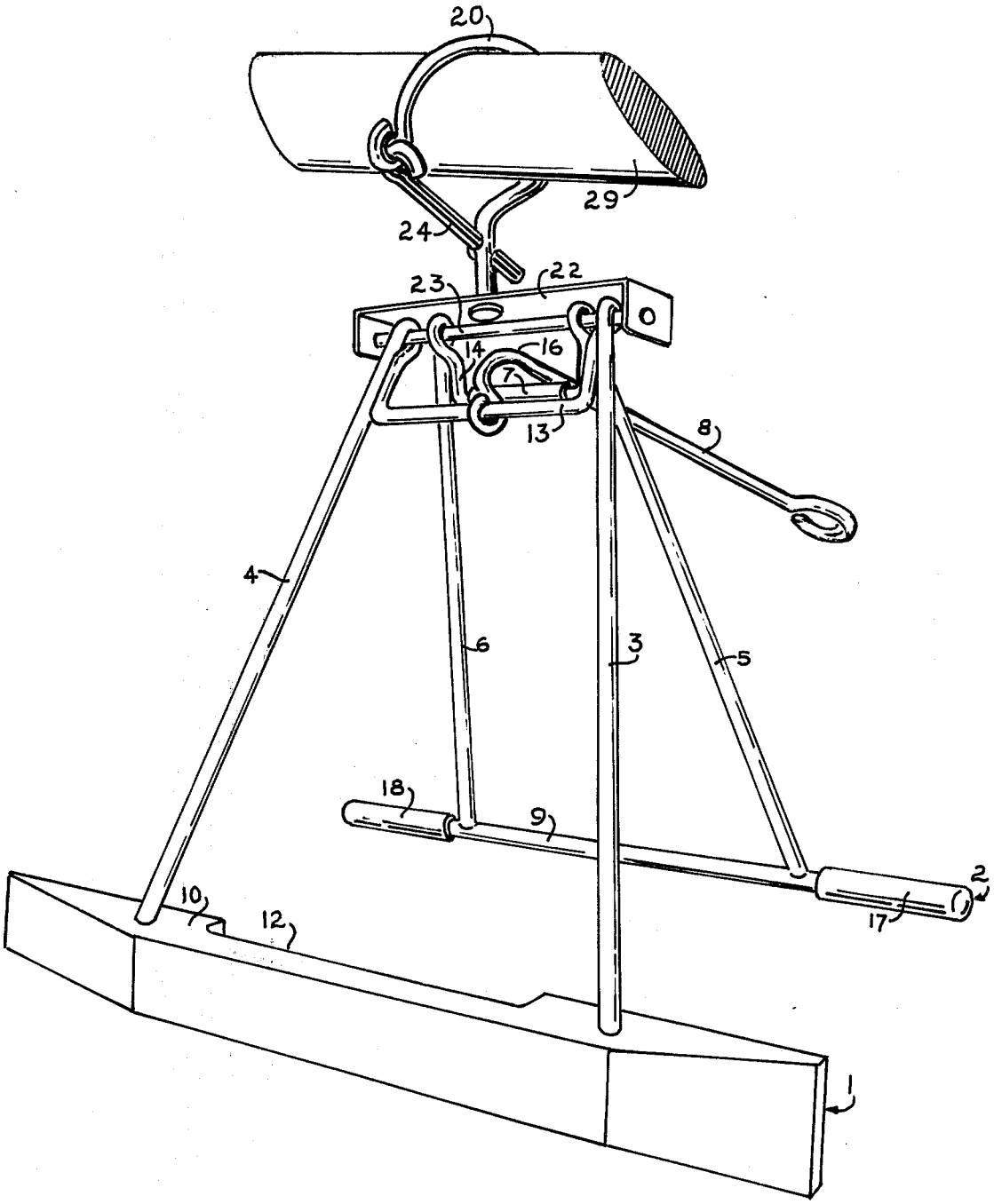
FIG. 7 is a perspective view of a complete hanger assembly.

Referring now to FIGS. 1 and 2, a hanger assembly is shown mounted around part of a shaft 15. One of the gripping jaws or sections 1 comprises a horizontal gripping member 10 made of an oblong block of wood or any other suitable material of approximately 20 centimeters in length having a notch 12 of approximately 7 centimeters cut out in its inside middle portion. The notch 12 is designed to accommodate the extra thickness of cloth usually caused by seams in the mid-section of a pants leg or of a skirt. Two legs 3 and 4 permanently imbedded in a block 10 are pivotally connected to the shaft 15 by having their upper ends wrapped around the shaft 15, then joining together in a U-shaped cross section 13. Legs 3 and 4 and cross-section 13 are formed from a single section of metallic wire.

The other gripping section 2 comprises a horizontal gripping member 9 made of a section of metallic rod approximately the same length as the wooden block 10. The rod is covered at each end section by sleeves 17 and 18 of a soft plastic or other high friction material. Two legs 5 and 6 are welded to the horizontal member 9 and are pivotally connected to the shaft 15 in the same manner as legs 3 and 4, but on opposite sides of it, and are joined together in a U-shaped cross-section 14. A latching-clamping lever, 8 having a hook shaped area 16 toward its upper end, is pivotally connected to the center of cross-section 13 and projects across cross-section 14 of the opposite gripping section 2. When pressed downward the lever 8 engages the cross-section 14 within its hooked portion 16, forcing the 2 gripping section 1 and 2 to close tightly together. The movement of the lever 8 against cross-section 14 is facilitated by a short metallic roller 7 loosely surrounding the horizontal part of cross-section 14.

The shaft 15, of which a partial section is shown in FIGS. 1 and 2, can be shaped into various configurations, some of which are described below. A hook assembly is shown in FIG. 3. The shaft 15 of FIGS. 1 and 3 is represented here by a pin 23 which runs through both ends of a bridge-shaped bracket 22 and whose ends are headed at 30 and 31 to prevent it from falling out of bracket 22. The pin 23 is sufficiently loose within bracket 22 so that the whole hook assembly can rotate around it. A hole 28 in the center of bracket 22 captures the lower end of the shank 21 of a suspending hook 20. Said end of the hook 20 is headed, so that the hook can swivel into, but not escape from bracket 22. This results in the hook 20 being both swivelledly and pivotally connected to pin 23. A loop 25 at the open end of hook 20 can receive a locking pin 23 designed to prevent the hook from coming off the suspending rod 29.

Pin 24 which is illustrated in FIG. 4 is shaped to bridge the opening between the open end of the hook and its shank 21. A closed loop 27 at one end is captured by loop 25 of the hook 20 while an open loop 26 is dimensioned to snap around the shank 21 of the hook 20. The pin 24 provides a semi-permanent means for locking the hanger around the suspending rod 291.

Another configuration of shaft 15 of FIGS. 1 and 2 is illustrated in FIG. 5. The gripping sections of the hanger are hinged around a leg 43 of a U-shaped rod or shaft 41 while the other leg 44 is captured by a bracket 42 mounted under a shelf 40. The leg section 44 of the rod is allowed to slide within the bracket 42, thus the whole hanger assembly can be pulled out from under the shelf by pulling at end 45. This allows for easy display of the garment, for inspection, for hanging it, or removing it from the hanger. Banks of such hangers can be mounted side by side under the same shelf. The configuration illustrated in FIG. 6 allows the L-shaped shaft 50 to be pivotally mounted by means of bracket 51 on the supporting structure 52. Bracket 51 is essentially similar to bracket 42 described in FIGS. 5, but is mounted on a vertical supporting structure 52 rather than under a shelf as shown in the previously described configuration.

Banks of closely spaced hangers can be mounted around a linear or cylindrical supporting structure without impeding the accessibility of the hangers.

In each of the above cases the U-shaped and L-shaped shafts are conveniently bent or headed at each end to prevent the shaft from coming off the bracket or the gripping sections from coming off the shaft.

It will, of course, be understood that certain modifications in the details of construction may be made in these embodiments without departing from the concept of the invention, and hence the invention is intended to be limited only by the scope of the appended claims and the reasonably equivalent structures to those defined therein.

What I claim is:

1. A hanger which comprises:

a central shaft;

two gripping sections pivotally connected to said shaft;

latching means for clamping the two gripping sections together;

a suspending hook; and a bridge-shaped bracket pivotally connected at each end of said shaft and swivelledly fastened in its center to the lower end of said hook.

2. A hanger which comprises a central shaft; a gripping section pivotally connected to said shaft comprising a horizontal oblong block having a notch in its center; two legs, formed by a single section of metallic wire extending vertically from said block, their upper ends wrapping around said shaft and joining together in a U-shaped cross section;

a gripping section similarly connected to said shaft comprising a horizontal section of metallic rod, two plastic sleeves covering the end sections of said rod; two legs, formed by a single section of metallic wire extending vertically from said rod, their upper ends wrapping around said shaft, and joining together in a U-shaped cross-section;

a hook-shaped lever pivotally connected to one of the cross-section and engaging the opposite cross-section; a short metallic roller loosely surrounding said opposite cross-section;

a suspending hook;

a bridge-shaped bracket pivotally connected at each end to said shaft and swivelledly fastened in its center to the shank section of the hook; and a pin for locking said hook to a suspending rod connecting the open end of the hook to its shank section.

* * * * *